United States Patent [19]

Craig

[11] Patent Number: 5,056,784

[45] Date of Patent: Oct. 15, 1991

[54] ATHLETIC SWING TRAINING DEVICE

[76] Inventor: Reggie Craig, 106 Dozent, Baytown, Tex. 77521

[21] Appl. No.: 525,355

[22] Filed: May 17, 1990

[51] Int. Cl.[5] ..... A63B 69/00

[52] U.S. Cl. ..... 273/26 R

[58] Field of Search ..... 273/26 E, 26 EA, 29 A, 273/58 C, 319, 413, 414; 272/76, 77, 78

[56] References Cited

U.S. PATENT DOCUMENTS

| | | | |
|---|---|---|---|
| 831,605 | 9/1906 | Doyle . | |
| 1,554,409 | 9/1925 | Coffee . | |
| 3,301,556 | 1/1967 | Hamilton Jr., et al. | 273/26 E |
| 3,475,026 | 10/1969 | Cooper | 273/26 E |
| 3,729,194 | 4/1973 | Barnett | 273/26 E |
| 3,948,517 | 4/1976 | Feiler | 273/26 E |
| 3,994,494 | 11/1976 | Kelly | 273/26 E |
| 4,138,107 | 2/1979 | Janis | 273/29 A |
| 4,322,075 | 3/1982 | Hynes | 273/26 E |
| 4,632,394 | 12/1986 | Ryan | 273/26 E |
| 4,735,413 | 4/1988 | Yamanouchi et al. | 273/413 |
| 4,867,448 | 9/1989 | Judd | 273/26 E |
| 4,886,267 | 12/1989 | Licciardi et al. | 273/26 R |

*Primary Examiner*—Theatrice Brown

[57] ABSTRACT

An athletic swing training device used for practicing the swing motion used in games such as baseball, tennis, racket or handball. The device includes a one-piece, essentially bow-shaped member; an elastic cord adjustably retaining a ball therealong; and attachment mechanisms attaching the member to a stable, vertical support.

4 Claims, 1 Drawing Sheet

ATHLETIC SWING TRAINING DEVICE

This invention generally relates to the field of athletic equipment, and more particularly, to sports devices for practicing and developing hitting techniques and improving the power of the player's swing.

Baseball and other athletic swing training devices have been known and used for many years. They are designed to help perfect the mechanics and strength of the user's swing while eliminating ball retrieval. Most of the conventional devices involve a ball tethered to some structure. These devices usually have a ball tethered to a frame or between a room's ceiling and a wall or floor. Some of the support structures of the frame devices are constructed of vertical pieces to which one or more other pieces are welded or bolted at 90° angles to provide one or more horizontal arms. In using a device of this type, the user hits the ball into the vertical member(s) of the device. The horizontal arms, therefore, must be long enough to enable follow-through on the swing without striking the vertical member(s). The combination of the 90° angles and the length of the horizontal arm results in a relatively weak structure. With use over a period of time, stress on the horizontal arm will further weaken the joints and cause the conventional device to collapse toward the point where the stress originates. To minimize this structural problem, the conventional devices are designed to conform to and be supported by the vertical and horizontal contours (i.e., ceiling, walls and floors) of a room or similar structure. Consequently, such devices are further disadvantaged by the limited number of locations where they can be installed.

SUMMARY OF THE INVENTION

It, therefore, is an object of the present invention to provide an inexpensive, durable, athletic swing training device that can be attached to a vertical, stationary object.

Another object of the invention is to provide a swing training device that evenly distributes the stress on the device over arcs.

Still another object of the invention is to provide a swing training device that allows the ball to be hit perpendicular to, but not into, the vertical member of the device (i.e., side to side) allowing for a shorter distance from the vertical member to the ball and allowing the device to take up less space.

Therefore, in accordance with the present invention there is provided an improved athletic swing training device which, includes a one-piece, essentially bow-shaped member; an extensible cord retaining a ball for movement therealong; and attachment mechanisms for attaching the member to a stable vertical support.

The bow-shaped member includes a straight portion, the length of which is most preferably about one-half the length of the entire member, and two arc shaped end portion which form the terminal ends of the support. Preferably, the member is approximately three to nine, most preferably six, feet in length. The arc-shaped portion may be circular or elliptical.

Other and still further objects, features and advantages of the present invention will be apparent from the following description of a presently Preferred embodiment of the invention.

DETAILED DESCRIPTION OF PREFERRED EMBODIMENT

Figure 1:
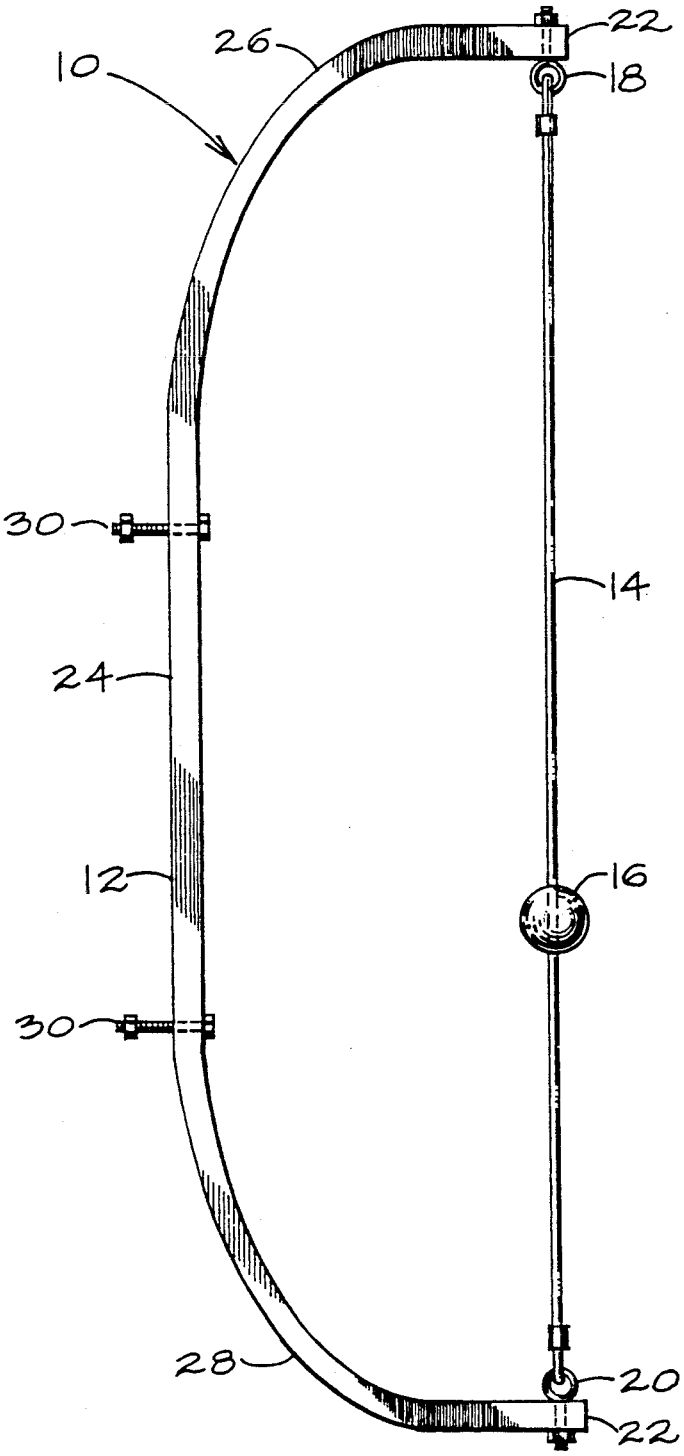
FIG. 1 is a side elevational view of the athletic swing training device.
Figure 2:
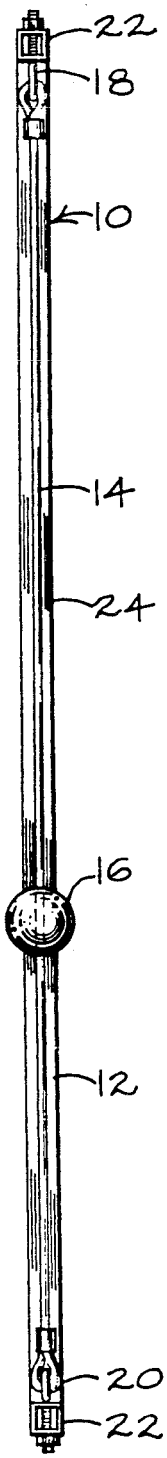
FIG. 2 is a front elevational view of the athletic swing training device.

Referring now to FIGS. 1 and 2, the present invention is generally indicated by the reference numeral 10 and includes a one-piece, bow-shaped member 12; an extensible cord 14 retaining a ball 16 therealong; and attachment mechanisms 18 and 20 for connecting the cord 14 to the terminal ends 22 of the member 12. The invention 10 can be adapted for baseball, tennis, racketball, handball or similar sports in which a ball is hit with a racket, bat or user's hand. One feature of the invention is that the device 10 can be attached to almost any stable, vertical object (not shown) by a variety of attachment mechanisms 30 such as lag bolts for attachment to wood and welds, U-bolts or machine bolts for attachment to metal.

Preferably, the member 12 is made of tubular steel and most preferably from square tubular steel. The square tubular steel minimizes twisting of the member 12 away from the vertical structure it is attached to by the forces applied to the member 12 when the ball 16 is hit. The bow-shaped member 12 has a straight line portion 24 connecting two arcs 26 and 28. The length of the member 12 can range from about three to nine feet. Preferably, the member 12 has a length of about 6 feet with the straight line portion 24 having a length approximately equal to one-half the total length of the member 12.

The arcs 26 and 28 have radii ranging from about six inches to 22 inches. Preferably, the arcs are mirror images of each other and circular with radii of about 15 inches. More preferably, the arcs 26 and 28 are mirror images and elliptical in shape with a longitudinal radius of approximately 16 inches and its perpendicular radius of approximately 12 inches. The arcs 26 and 28 enable equal distribution of stress over their length and increase the durability and strength of the member 12.

At the terminal ends 22 of the member 12, the extensible cord 14 is connected to the member 12 by attachment mechanisms 18 and 20. The cord 14 is a flexible, resilient cord such as a shock cord. The attachment mechanisms 18 and 20 may be identical or any combination of a variety of mechanisms including hooks and eyes, eye bolts, locks and clamps. An advantage in connecting the extensible cord 14 to the two terminal ends 22, is after being hit, the ball 16 stops oscillating and returns to a position of repose sooner than it would if the cord 14 were connected to only one terminal end 22.

The ball 16, having a diametric bore, surrounds the extensible cord 14 and can be moved to any position along the cord's length. The ball 16 is hit perpendicular to, but not into, the member 12 (i.e., "side to side"). When the ball 16 is hit, the extensible cord 14 yields to the force applied to the ball 16 by the user's bat, racket or hand. Once the cord 14 reaches its yield point, the cord 14 returns the ball 16 to a position of repose.

The extensible cord 14 is spaced essentially parallel to and at a sufficient distance from the straight line portion 24 for the ball 16 to be hit from "side to side" without striking the member 12. This horizontal pacing is from about 12 to 30 inches, most preferably about 18 inches.

The arrangement, elements and method of use minimize the distance needed between the ball 16 and any vertical structures for an unobstructed follow-through on the swing and allow full extension of the cord 14 by force applied to the ball 16.

The present invention is well adapted to carry out the objects and obtain the ends and advantages mentioned, as well as others inherent therein. While presently preferred embodiments of the invention have been described for the purpose of disclosure, numerous changes in the details of construction and arrangement of parts may be made without departing from the spirit of the present invention and scope of the appended claims. It should be understood, however, that there is no intention to limit the invention to the specific form disclosed, but on the contrary, the invention is to cover all modifications, alternative constructions and equivalents falling within the spirit of the present invention and the scope of the appended claims.

What is claimed is:

1. An athletic swing training device, comprising:

a one-piece bow-shaped member having first and second arc-shaped terminal end portions;

an elongated elastic cord having a ball adjustable attached intermediate the ends thereof, said bow-shaped member having a straight portion extending between said arc-shaped end portions, said arc-shaped end-shaped portions being of equal radii;

means for connecting said device to stable vertical support.

2. The device of claim 1 further comprising means for connecting said cord to said terminal ends of said member.

3. The device of claim 1, wherein said arc-shaped portions are elliptical.

4. The device of claim 1, wherein said ball is diametrically bored, surrounds said elastic cord and is slidable along the length of said cord.

* * * * *